United States Patent [19]

Bouchée

[11] Patent Number: 4,560,535

[45] Date of Patent: Dec. 24, 1985

[54] SAMPLE COLLECTOR

[75] Inventor: Bernhard Bouchée, Kriftel, Fed. Rep. of Germany

[73] Assignee: Hoechst Aktiengesellschaft, Frankfurt, Fed. Rep. of Germany

[21] Appl. No.: 570,510

[22] Filed: Jan. 13, 1984

[30] Foreign Application Priority Data

Jan. 15, 1983 [DE] Fed. Rep. of Germany ... 8300950[U]

[51] Int. Cl.[4] ..... B01L 3/14; B01L 9/06; B65D 1/36

[52] U.S. Cl. ..... 422/102; 206/558; 206/563; 211/74; 220/20; 220/23.83; 220/410; 422/104

[58] Field of Search ..... 422/102, 104; 435/293; 436/808, 809; 356/246; 220/23.8, 23.83, 408, 410, 20, 21; 206/558, 562, 563; 73/864.91; 211/74

[56] References Cited

U.S. PATENT DOCUMENTS

| | | | |
|---|---|---|---|
| 3,613,881 | 10/1971 | Oldenbarg | 220/23.8 X |
| 3,680,967 | 8/1972 | Engelhardt | 73/864.91 X |
| 3,785,773 | 1/1974 | Rohrbaugh . | |
| 3,905,772 | 9/1975 | Hartnett et al. | 436/808 X |
| 4,154,795 | 5/1979 | Thorne | 220/23.8 X |
| 4,245,052 | 1/1981 | Lund | 356/246 X |

FOREIGN PATENT DOCUMENTS

| | | | |
|---|---|---|---|
| 2117279 | 9/1973 | Fed. Rep. of Germany . | |
| 2435317 | 2/1976 | Fed. Rep. of Germany | 356/246 |
| 2110030 | 5/1972 | France . | |
| 1392792 | 4/1975 | United Kingdom . | |

*Primary Examiner*—Allan N. Shoap

*Attorney, Agent, or Firm*—Finnegan, Henderson, Farabow, Garrett & Dunner

[57] ABSTRACT

Apparatus for collecting test samples including a support plate and a plurality of integrally connected vessels, which are supported by the support plate. The support plate includes an upper surface having a predetermined number of recesses aligned in at least one row. The internal dimensional configuration of one of the recesses in each of the rows is different from the configuration characteristic of the remainder of the recesses in the row. The recess with the different internal dimensional configuration is asymmetrically disposed along each of the rows. The vessels from at least one line and the number of vessels in each line is equivalent to the predetermined number of recesses in one of the rows. The base of the vessels has a shape corresponding to the internal dimensional configuration of an opposing recess, such that the base of one of the vessels in each line is different from the remainder of vessels in the same line. Each line of vessels is capable of being positioned within a corresponding one of the rows in only one sequence.

6 Claims, 7 Drawing Figures

FIG. 1
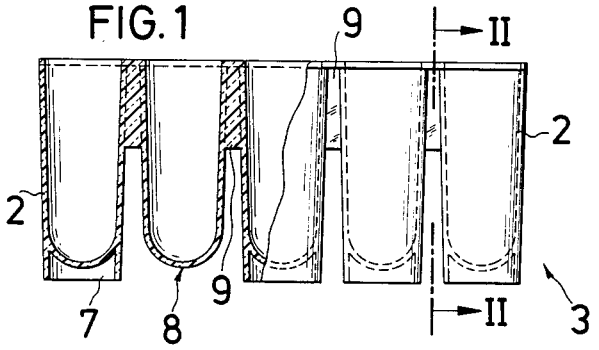
FIG. 2
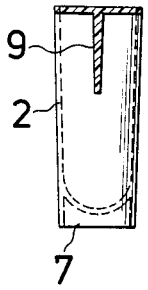
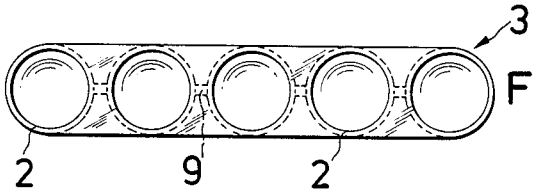
FIG. 3
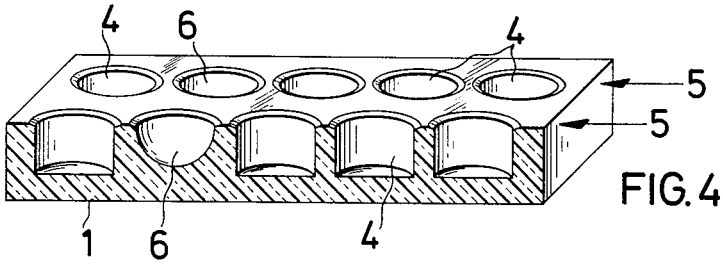
FIG. 4
FIG. 1a
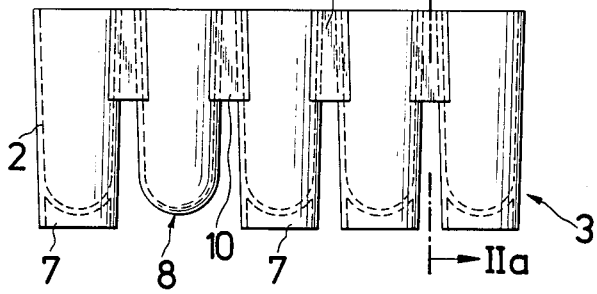
FIG. 2a
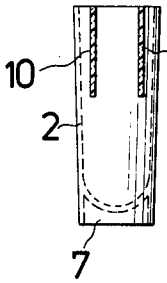
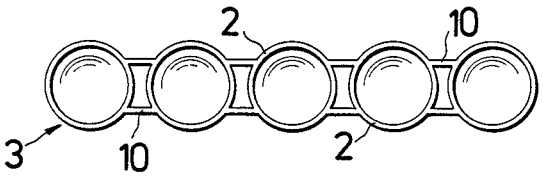
FIG. 3a

SAMPLE COLLECTOR

BACKGROUND OF THE INVENTION

1. Field of the Invention

The present invention relates to a test sample collector comprising a cassette having recesses arranged in rows and vessels, which are linked together in strips and supported by the cassette.

2. Background of the Invention

The object of the present invention is to ensure that test sample vessels, which are linked together in strips and which have to be removed from the cassette of the sample collector for treating or investigating the samples, are always returned to the cassette in the same sequence to avoid confusing the samples.

SUMMARY OF THE INVENTION

The object and advantages of the sample collector of the present invention are achieved by a support plate having an upper surface and including a predetermined number of recesses aligned in at least one row. One of the recesses in each row has a shape differeing from the others and it is located asymmetrically in the row. A plurality of vessels are integrally connected to form at least one line or strip. The base of each vessel has a shape corresponding to the shape of the recesses. Each strip contains one sample vessel which is asymmetrically located along the strip, the base of which corresponds geometrically to the shape of the recess which is asymmetrically located and differs from the other recesses in the row.

In a particular embodiment, five recesses are arranged in each row of the support plate, one of these recesses differing geometrically from the other, and the strips are formed of five sample vessels, one of these being provided with a base which corresponds geometrically to the recess which differs.

The geometric shape of the asymmetrically located recesses and the corresponding vessel may be hemispherical, pyramidal, cubic or the like.

BRIEF DESCRIPTION OF THE DRAWINGS

FIG. 1 shows a side view, partly cut away, of sample vessels of the present invention which are liked in a strip, each of them being attached by a web;

FIG. 2 shows the section viewed in the direction of arrows II—II in FIG. 1;

FIG. 3 shows a top plan view of a strip of sample vessels;

FIG. 4 shows a partial section of the cassette and a row of recesses for receiving the same vessels; and FIGS. 1*a* to 3*a* show a variant of the strips of sample vessels as shown in FIGS. 1 to 3.

DESCRIPTION OF THE PREFERRED EMBODIMENT

Reference will now be made in detail to a presently preferred embodiment of the invention, examples of which are illustrated in the accompanying drawings.

The preferred embodiment of the test sample collector comprises a support plate 1 and a plurality of sample vessels 2, which are viewed together in FIGS. 1 and 4. The sample vessels 2 are linked in strips 3. Each strip 3 may contain any number of sample vessels 2 greater than two and preferably five. The support plate 1 has cylindrical recesses 4 which are arranged in rows 5. In each row 5, there is a recess 6 which is located asymmetrically and the geometric shape of which differs from the shape of the other recesses in the row. With the exception of one vessel 2, each of the sample vessels 2 has a similarly shaped base 7 for vertically supporting the vessels 2 within a similarly shaped recess 4. Only one sample vessel 2 in the strip 3 has a dissimilar base 7 for standing, and thus the shape of its base part 8 differs from the shape of the base of the other sample vessels 2. The individual sample vessels are attached to each other by single webs 9 or by double webs 10 and thus, in each instance, form an integrally connected strip 3 of vessels 2.

What is claimed is:

1. An apparatus for collecting test samples comprising:

a support plate having an upper surface and including a predetermined number of recesses aligned in at least one row along said upper surface, the internal dimensional configuration of one of said recesses in each of said rows being different from the configurations characteristic of the remainder of said recesses in said row, said recess with the different internal dimensional configuration being asymmetrically disposed along each of said rows; and a plurality of adjacent, integrally connected vessels aligned in at least one line, the number of said vessels in each of said lines being equivalent to the predetermined number of said recesses in said at least one row of recesses, said vessels having base portions for mating with respective ones of said recesses and being supported thereby, said base portion of each of said vessels having a shape corresponding to the internal dimensional configuration of said mated recess and the base of one of said vessels in said line being different from the remainder of said vessels in said line, such that each of said lines of vessels is supported within a corresponding one of said rows in only one sequence.

2. The apparatus for collecting test samples as defined in claim 1, wherein each of said lines of said vessels include T-shaped flanges for integrally connecting each of said vessels with individual ones of said flanges.

3. The apparatus for collecting test samples as defined in claim 1, wherein each of said lines of said vessels include substantially parallel flanges for integrally connecting each of said vessels with one set of said parallel flanges.

4. An apparatus for collecting test samples comprising:

a support plate having an upper surface and including a predetermined number of recesses aligned in a plurality of rows along said upper surface, the internal dimensional configuration of one of said recesses in each of said rows being different from the configuration characteristic of the remainder of said recesses in said row, the remainder of said recesses having a substantially cylindrical internal dimensional configuration, said recess with the different internal dimensional configuration being asymmetrically disposed along each of said rows;

a plurality of adjacent, integrally connected vessels aligned in a plurality of lines, the number of said vessels in each of said plurality of lines being equivalent to the predetermined number of said recesses in said plurality of rows of said recesses, said vessels in each of said plurality of lines having base portion for mating with respective ones of said recesses and being supporting thereby, said base portion of each of said vessels in each of said plurality of lines having a shape corresponding to the internal dimensional configuration of said mated recess and the base of one of said vessels in said line being different from the remainder of said vessels in said line, said base portion of the remainder of said vessels in said line being defined by a support ring, such that said plurality of lines of said vessels is supported within said plurality of rows of said recesses in only one sequence.

5. The apparatus for collecting test samples as defined in claim 4, wherein each of said lines of said vessels include T-shaped flanges for integrally connecting each of said vessels with individual ones of said flanges.

6. The apparatus for collecting test samples as defined in claim 4, wherein each of said lines of said vessels include substantially parallel flanges for integrally connecting each of said vessels with one set of said parallel flanges.

* * * * *